US008317564B1

(12) United States Patent
Buhrman

(10) Patent No.: US 8,317,564 B1
(45) Date of Patent: Nov. 27, 2012

(54) CHILDREN'S BUILDING SYSTEM

(76) Inventor: Gary Buhrman, Ballwin, MO (US)

( * ) Notice: Subject to any disclaimer, the term of this patent is extended or adjusted under 35 U.S.C. 154(b) by 301 days.

(21) Appl. No.: 12/647,591

(22) Filed: Dec. 28, 2009

(51) Int. Cl.
*A63H 33/08* (2006.01)

(52) U.S. Cl. ..... 446/108

(58) Field of Classification Search ..... 446/108
See application file for complete search history.

(56) References Cited

U.S. PATENT DOCUMENTS

| | | | | |
|---|---|---|---|---|
| 1,281,856 | A | 10/1918 | Shaw | |
| 2,388,297 | A | 11/1945 | Slaughter | |
| 3,486,287 | A | 12/1969 | Guillon | |
| 4,334,868 | A | 6/1982 | Levinrad | |
| 4,774,792 | A * | 10/1988 | Ballance | 52/285.2 |
| 5,277,512 | A | 1/1994 | Dwillies | |
| D361,631 | S | 8/1995 | King | |
| 5,487,690 | A | 1/1996 | Stoffle et al. | |
| 5,647,181 | A | 7/1997 | Hunts | |
| 5,810,639 | A | 9/1998 | Liu | |
| 6,004,182 | A | 12/1999 | Pasin | |
| D421,655 | S | 3/2000 | Daugherty et al. | |
| 7,108,577 | B2 * | 9/2006 | Peters et al. | 446/124 |
| 2004/0198141 | A1 * | 10/2004 | Buhrman et al. | 446/85 |
| 2009/0092774 | A1 * | 4/2009 | Kichijo et al. | 428/33 |

* cited by examiner

*Primary Examiner* — Michael Dennis
(74) *Attorney, Agent, or Firm* — Polster, Lieder, Woodruff & Lucchesi, L.C.

(57) ABSTRACT

A children's building system is comprised of panels that can be connected together to form a structure formed from one or more layers of connected panels. The panel includes a connecting flange along one side edge and a channel member along an opposite side edge. The channel member is sized, configured, and shaped to receive the connecting flange of an adjacent panel, such that panels can be connected together to form a "wall". In one embodiment, the system includes a connector to vertically connect the panels. The connector defines upper and lower channels or slots and can rest on a lower panel and receive an upper panel, thereby enabling a second level of panels to be formed over the first level of panels. In another embodiment, the panels include a tongue on an upper edge and an downwardly opening slot in the bottom edge, wherein the tongue is sized and shaped to be received in the slot. In both instances, vertical walls of a desired height can be constructed, but the ability to form horizontal "floor" or "ceiling" surfaces is substantially prevented.

13 Claims, 6 Drawing Sheets

CHILDREN'S BUILDING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Disclosed herein is a building systems for use by children which allows children to build structures, and, particularly, a building system which allows for children to use their imagination to building a structure.

Building systems for children, such as blocks, Tinker Toys®, Legos®, etc., are well known and have been a staple of the home, pre-schools, day care centers, etc. for a long time. Children play with these different systems to build structures as inspired by their imagination, and then play with the structures built. Some building systems have components that are large enough for children to blocks structures large enough for the children to play in. One concern with such larger building systems is that the children may want to climb on the structures they build.

BRIEF SUMMARY OF THE INVENTION

Briefly stated, a children's building system comprises a panel and a connector. The panel includes a front face, a back face, a top edge, a bottom edge, a first side edge and a second side edge. A connecting flange extends along the first side edge and is generally normally to the front and back faces. A channel member extends along the second side edge. The channel member defines at least one slot sized and shaped to slidingly receive the connecting flange of an adjacent panel to horizontally connect two panels. The channel member is preferably integral with the panel, but can be a separate element if desired. The slot of the channel member has a width at a top and bottom of the channel member slot greater than the width of the connector flange to easily and slidably receive the connecting flange of an adjacent panel. However, the width of the channel member slot decreases toward a central portion of the channel member slot to a size which will generate a friction fit between the connecting flange and the channel member slot.

The connector comprises a front face, a back face, a top edge, a bottom edge and side edges. The front and back faces are spaced apart by a spacer to define upper and lower channels between the front and back faces. The connector channels are sized to receive the top and bottom edges of the panels such that two panels can be vertically connected.

In accordance with one aspect of the building system, the connector has a first part with one height and second part with a second height, the first and second heights being different. Additionally, the panel comprises upper and lower projections spaced inwardly from the top and bottom edges. The projections (which can be defined by a flange) are shaped complementarily to the peripheral top and bottom shape of the connector, such that the connector cannot move laterally relative to the panels in a column of panels. For example, the connector and the projection can each define a curvilinear shape defining both a convex portion and a concave portion.

In another embodiment, the panel comprises a slot extending inwardly from either the top or bottom edges of the panel, and the panel then defines a tongue at the opposite edge of the panel which is sized and shaped to be received in the slot. Thus, in the illustrative embodiment, the groove extends inwardly from the bottom edge, and the top of the panel defines the tongue. The tongue is defined by a portion of the panel which has a side-to-side width that is narrower than the rest of the panel. The tongue and slot are shaped complementarily to each other. Preferably, the panel top edge is convex.

The connector of the first described embodiment and the tongue and groove of the second described embodiment each form or define means which allow panels to be connected together vertically while at the same time preventing the formation or construction of a horizontal "floor" or "ceiling" in a structure being built from said panels.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
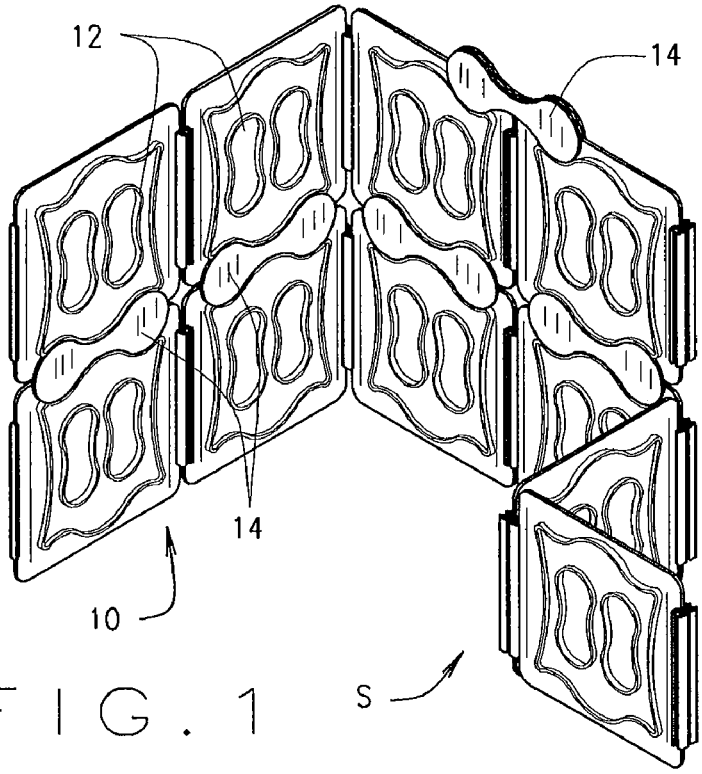
FIG. 1 is a perspective view of a structure built using the building system.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention as set forth in the claims is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A structure S constructed or built using a building system 10 is shown in FIG. 1. The building system 10 is comprised of two elements—a panel 12 and a connector 14. As will be described below, the panels can be connected together to form a layer—that is, the panels can be connected horizontally. The connector 14 allows for the structure to be built up, i.e., for a second layer of panels to be assembled over the first layer of panels. By using a plurality of panels 12 and connectors 14, a structure 10 can be made. Depending on the number of panels and connectors used, the structure 10 can be a simple square or a square tower, or it can be a complex "fort" which children can play in after it is built.

Figure 2:
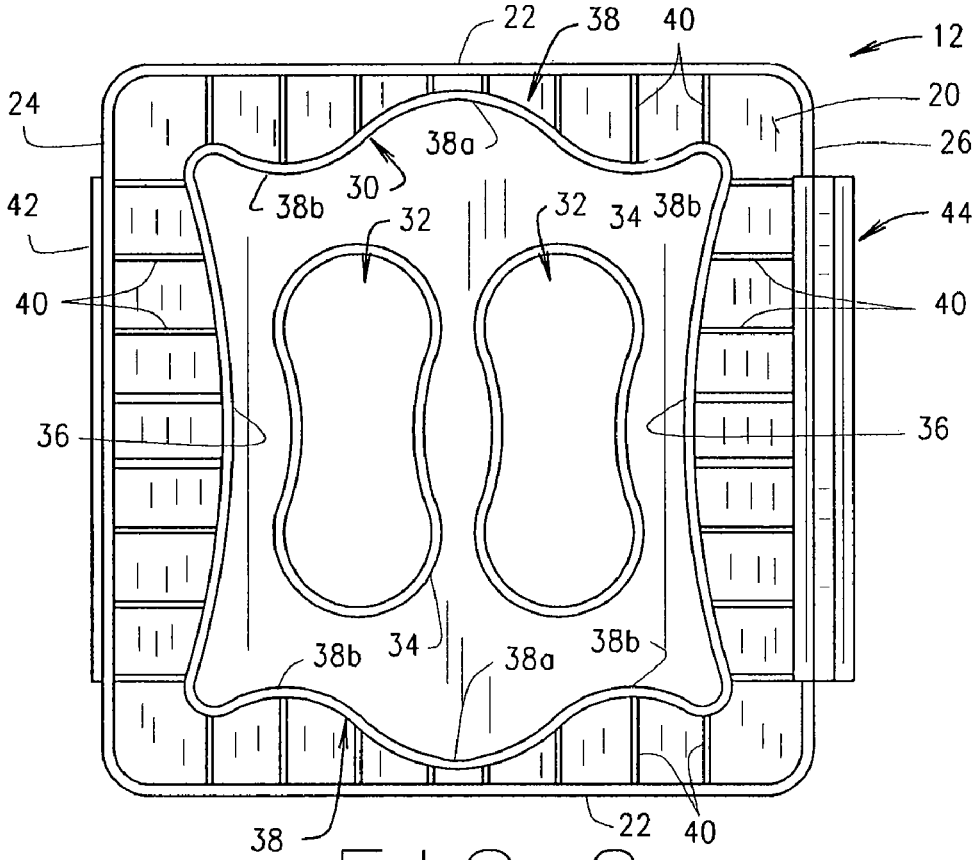
FIG. 2 is a perspective view of a panel of the building system.
Figure 3:
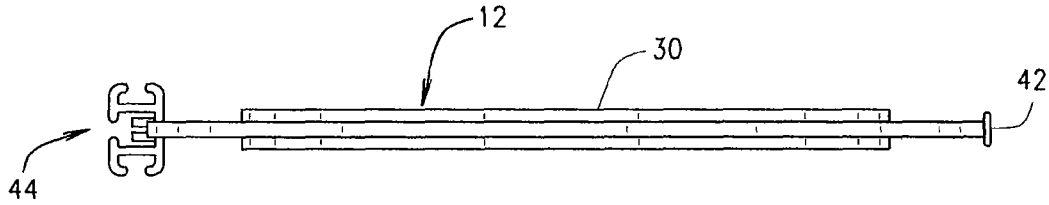
FIG. 3 is a top plan view of the panel.
Figure 4:
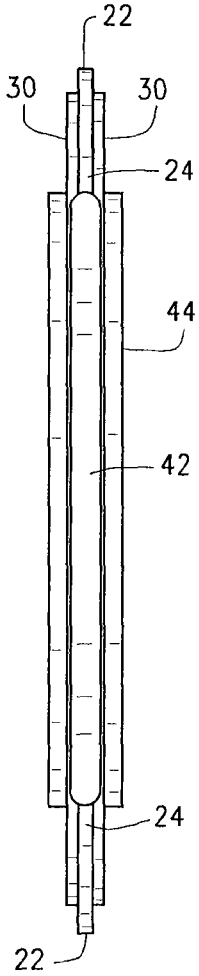
FIG. 4 is an end elevational view of the panel

Turning to FIGS. 2-3, the panel 12 is shown to be a square. Preferably, the panel is sized such that children can play in a structure they build with the building system. For example, the square defined by the panel can be 14" on a side. Other sizes of squares can be used as well. Although a square is panel is preferred, the panel could be rectangular—such that one rectangular panel is equivalent to two or more square panels. The corners of the panel 12 are preferably rounded to eliminate sharp corners.

The panel 12 comprises front and back faces 20, top and bottom edges 22, and side edges 24 and 26. The panel faces 20 each include a central portion 28 defined by an outwardly extending flange 30. This central portion 28 is preferably smooth, and contains apertures or holes 32. The holes 32, as seen, are surrounded or defined by outwardly extending flanges 34. The holes 32 allow for a teacher, parent, guardian, etc. to see inside of a structure built using the building system, so that children cannot easily "hide" in any structure they build. The flange 30 defining or framing the central portion 28 has slightly concave sides 36 and a curvilinear top and bottom 38. The top and bottom 38 of the flange 38 includes a central convex portion 38*a* and side concave portions 38*b*. The corners where the top and bottom of the flange 30 join the sides of the flange 30 are curved to eliminate sharp corners. Finally, ribs 40 extend from the sides 36 and the top and bottom 38 of the flange 30 toward the sides and top and bottom of the panel face 20.

To connect two panels 12 together, the panels 12 each include a connecting flange 42 at the panel side edge 24 and a channel member 44 at the panel side edge 26. The connecting flange 42 extends generally normal to the face 20, as best seen in FIG. 3 and includes rounded top and bottom ends. The width of the connecting flange is generally constant over the length of the connecting flange. The connecting flange, as illustratively shown, does not extend the full length of the side edge, and is preferably centered relative to the side edge. It will be noted that the connecting flange and the channel member are on the panel side edges only. The panels do not include a connecting flange or a channel member on a top or bottom edge. Hence, the panels can only be connecting with the panels in a vertical orientation—the system does not allow for the construction of a structure that has a horizontal surface (i.e., a roof or a floor).

Figure 5:
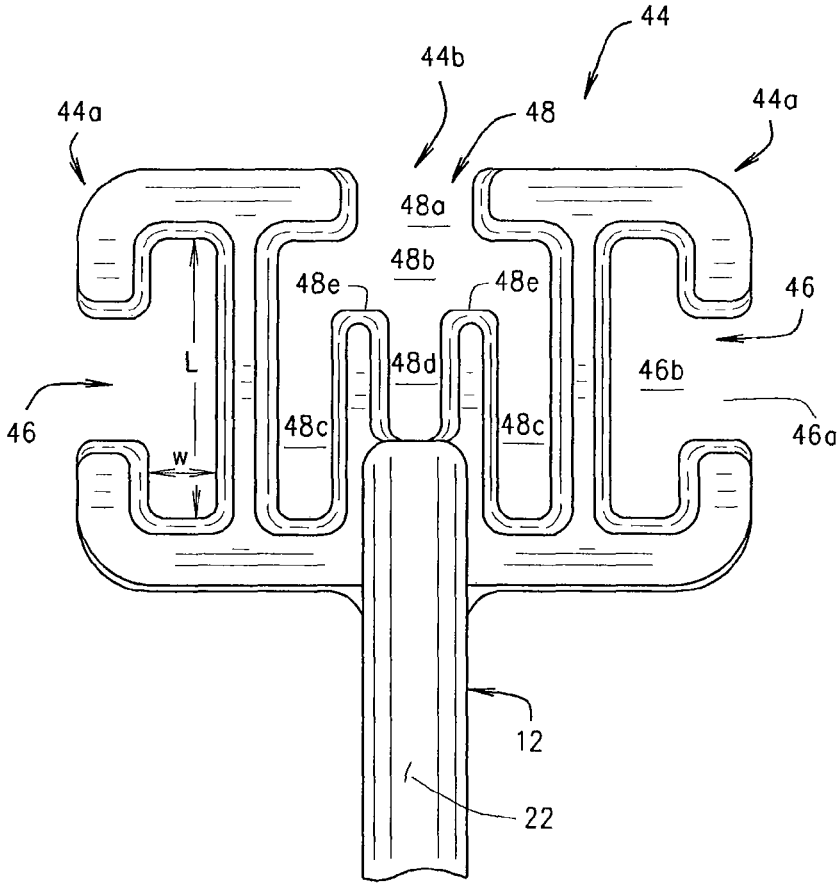
FIG. 5 is an enlarged plan view of a connector edge of the panel.
Figure 6:
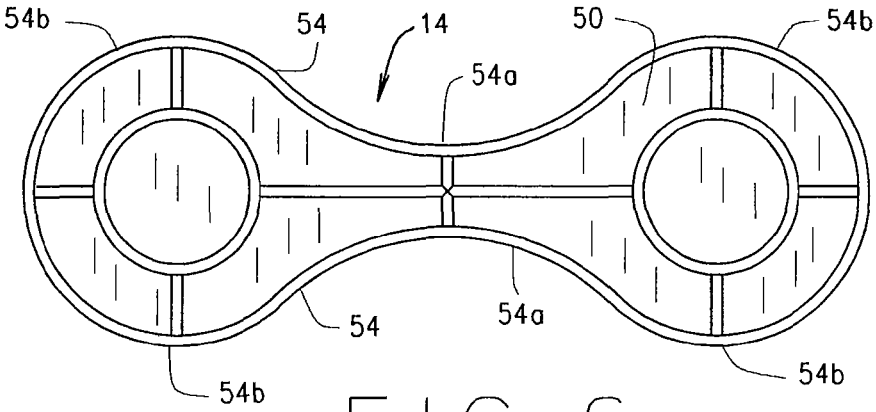
FIG. 6 is a top plan view of a connector of the building system.
Figure 8:
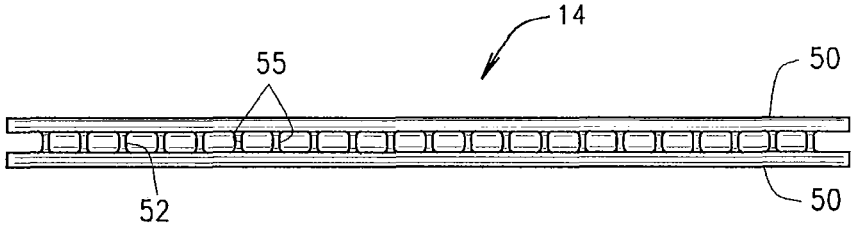
FIG. 8 is a top plan view of the connector.
Figure 7:
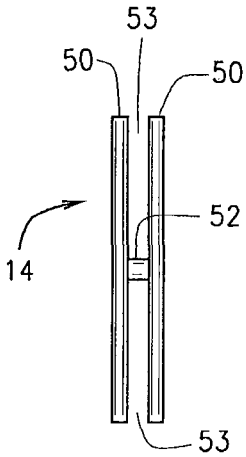
FIG. 7 is a top plan view of the connector.
Figure 9A:
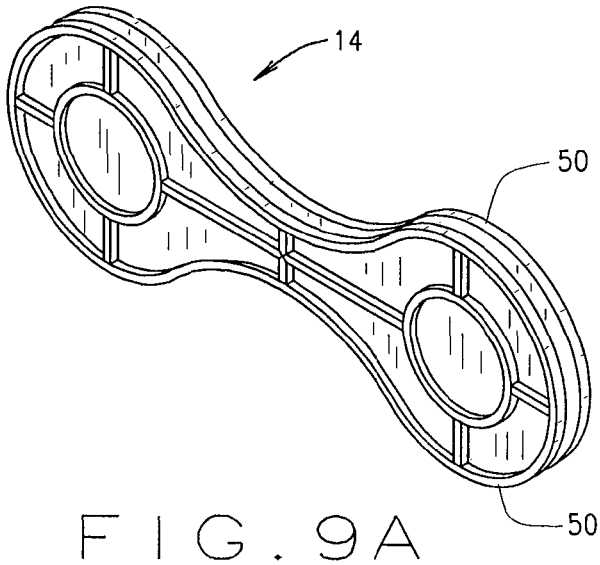
FIGS. 9A and B are perspective views of the connector.
Figure 9B:
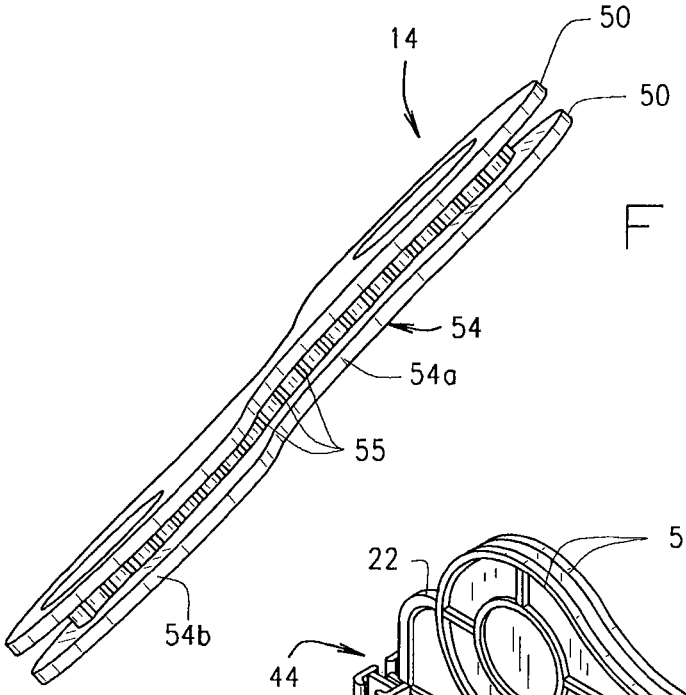

The channel member 44 extends from the opposite side edge 26. As seen best in FIG. 5, the channel member 44 has two side portions 44*a* and a center portion 44*b*. The side portions 44*a* are identical. Each includes a generally T-shaped slot 46. The slot 46 comprises an opening 46*a* which faces away from the face 20 of the panel 12 and a channel 46*b* which is generally parallel to the face of the panel. The opening 46*a* is sized to receive the side edge 24 of an adjacent panel; and the channel 46*b* is sized to receive the connecting flange 42 of the adjacent panel. To this end, the channel 46*b* has a length L and a width W. The channel length L is slightly greater than the side-to-side width of the connecting flange 42. The channel width W is slightly greater than the thickness of the connecting flange 42 at the top and bottom of the channel, but narrows slightly in the middle of the channel to form a slight friction fit between the connecting flange 42 and the channel member 44.

The central portion 44*b* of the channel member 44 includes a slot 48 having an opening 48*a* and a channel 48*b*. The opening 48*a* is generally co-linear or aligned with panel 12 and the channel 48*b* is generally perpendicular to the panel 12. Like the opening 46*a* and channel 46*b* of slot 46, the opening 48*a* is sized to receive the side edge of an adjacent panel, and the channel 48*b* is sized to receive the connecting flange 42 of an adjacent panel. Again, like channel 46*b*, the channel 48*b* is sized to have a width that varies over its length, such that the cannel will easily receive the connecting flange 42 at the top or bottom of the channel 48*b*, yet which narrows slightly to form a slight friction fit between the flange 42 and the channel 48*b*. The slot 48 is shown with a pair of side channels 48*c* and a center channel 48*d*. The side channels 48*c* and center channel 48*d*, in combination, define a pair of fingers 48*e*. The end edges of the fingers 48*e*, in turn, define an edge of the channel 48*b* which receives the connecting flange 42 of the adjacent panel. The channels 48*c* and 48*d* are included primarily to reduce material used to make the channel member 44. The channel member 44 could have a solid center, in which case, the center slot 48 would be identical in shape to the side slots 46.

Panel members are simply connected together by inserting the connecting flange 42 of a first panel in one of the channels 46, 48 of the channel member 44 of a second panel. If the connecting flange 42 of the first panel is inserted in one of the slide slots 46 of the second panel channel member, then the two panels will be at right angles to each other. If the connecting flange 42 of the first panel is inserted in the center slot 48 of the second panel channel member, then the two panels will be co-linear, and will define a straight "wall". Using only the panels 12, a one-level structure can be assembled. This structure can be a square or a rectangle; it can be L-shaped or have any other desired shape. As seen, the channel member limits the connections between adjacent panels to 90° connections or 180° connections. However, if desired, the channel member could be provided with additional slots. For example, the channel member could be generally hexagonal and be provided with five slots, thereby allowing panels to be connected together at to define angles of 60°, 120°, 180°, 240° and 300° angles. This would allow for triangular spaces and/or hexagonal spaces to be built. Or, the channel member could be generally octagonal and be provided with seven slots, thereby allowing panels to be connected together to define angles of 45°, 90°, 135°, 180°, 225°, 270° or 315°. This would provide even more flexibility, allowing for triangular, quadrilateral, hexagonal or octagonal spaces to be built.

The channel member 44 is preferably integrally formed with the panel, allowing for the building system to comprise only two distinct types of pieces (i.e., the panel member 12 and the connector 14). However, if desired, the channel member 44 could be separate from the panel 12. In this instance, the panel 12 would include connecting flanges 42 on each of the side edges of the panel, and the channel member would include a fourth slot, opposite, and identical to, the center slot 48.

With out the use of the connecting member 14, a structure of only one level can be built. The connecting member 14 allows for an upper layer of panels to be constructed on top of a lower layer of panels. Turning to FIGS. 6-9, the connecting member 14 comprises a pair of opposed plates 50 spaced apart by a spacer 52 to define upper and lower channels 53 between the plates 50 on opposite sides of the spacer 52. The spacer 52 can comprise a continuous bar, or, as shown in the Figures., a plurality of discrete ribs 55. The spacer 52 extends substantially along the middle of the connecting member 14. The spacer 52 spaces the faces 50 apart a distance sufficient to receive the top or bottom edges of a panel between the faces 50.

Figure 10:
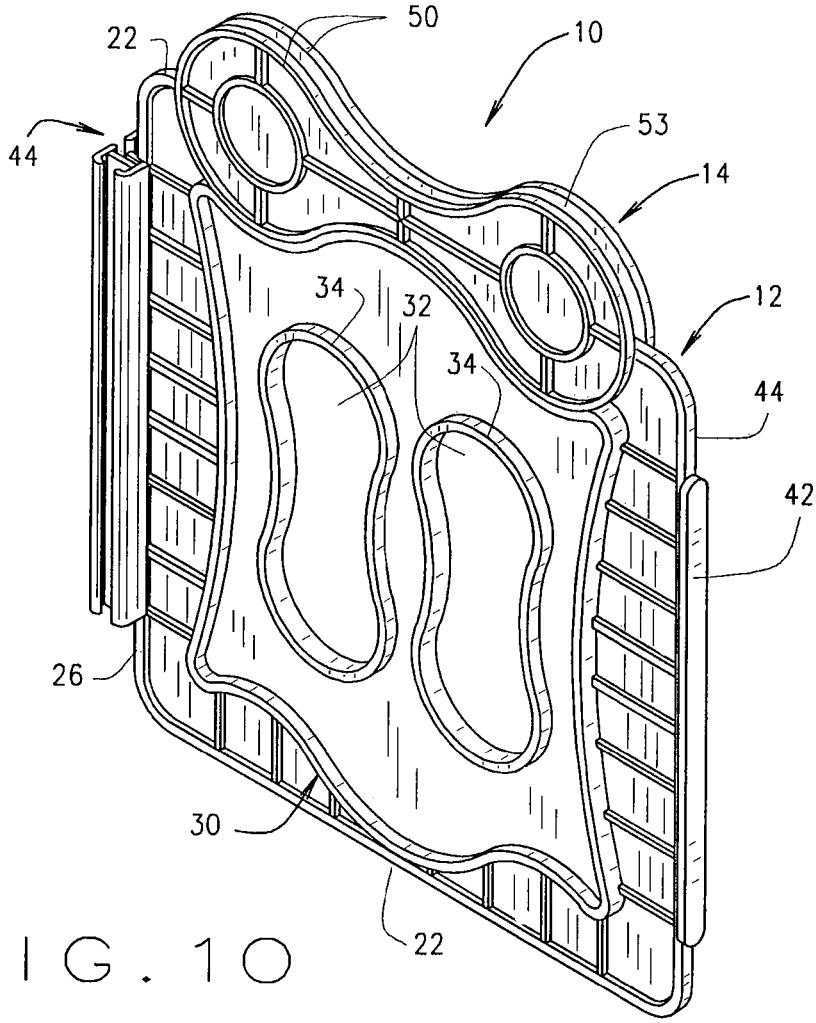
FIG. 10 is a perspective view of a connector on a panel.

The connecting member plates 50 have top and bottom edges 54 that are shaped complimentarily to the upper sides 30*a* of the flange 30 of the panel 12. To this end, the top and bottom edges 54 of the connector faces 50 each have a concave center portion 54*a* and convex outer portions 54*b*. The ends of the connector face are rounded, giving the connector 14 a generally peanut-shaped appearance. The connector 14 can alternatively be viewed as having two circular end portions which are joined by a connecting portion having generally concave edges. In either case, the complementary shape of the connector 12 to the panel flange 30 allows for to the connector to rest on the flange, as seen in FIG. 10. Further, the complementarily shaped connector 14 and flange 30 substantially prevent the connector 14 from moving transversely relative to a panel top or bottom edge. The connector 14 and flange 30 could have other complimentary shapes. However, the curvilinear shape of the flange 30 and the connector 12 in essence force the connector 14 sit on the panel 12 as seen in FIG. 10. That is, because of the shape of the connector 14 and flange 30, the connector 14 will naturally come to rest on the flange 30 as shown in FIG. 10. The depth of the connector channel 53 (or the distance between the edge of the connector and the spacer 52), and the relative size of the panel 12 outside of the flange 30 allow for the connector spacer 52 to be adjacent the top or bottom of the panel 12 when the connector is placed on the panel 12.

When a structure is being built, the panels, as noted, are used to build a "level" of the structure. A second or additional "level" of the structure is made using the connectors 14, as seen in FIG. 1. When a second level is desired to be added, a connector 14 is positioned on a top edge of a lower panel and the bottom edge of an upper panel is inserted in the top half of the connector. One connector is needed between each panel in a column of panels. Thus, for instance, a square tower two levels tall would use eight panels 12 and four connectors 14. A square tower three levels tall would use twelve panels and eight connectors. Because the connector 14 is shaped complementarily to the flange 30 of the panels joined by the connector, the panels will not be able to slide relative to each other. This will help increase the rigidity of a structure made with the building system 10.

As described above, the use of the connector 14 allows for one panel 12 to be positioned atop a lower panel 12, to thereby form a vertical column of panels. While a structure of vertical columns will stand, it is not the most stable of structures. However, the size of the connector 14 allows for the connector to span between to adjacent panels, as see in FIG. 1. Thus, the connector 14 can span between two columns of panels, and connect columns of panels. If a structure is built with the connectors extending between adjacent panels, the panels of an upper layer will extend across the gap between adjacent panels in the layer below, producing a brick-like construction. The respective size of the connector 14 and the shape of the flange 30 of the panels allows for the connector 14 to come to rest on the flanges of adjacent panels 12 substantially in the same way the connector comes to rest when applied to a single panel. This will enable the children to build a structure having vertical walls which are structurally stronger than walls composed of adjacent columns.

The building system 10 allows for simple or complex structures to be built, and, using the connectors 14, the structures can be made as tall as desired. However, due to the size of the panels, and the fact that the panels 12 lack connecting flanges and channel members on the top and bottom edges, the building system 10 does not allow for any horizontal surfaces to be formed. Therefore, in any structure, all the panels 12 will be generally vertically oriented. Thus, while a square can be formed, a cube cannot be formed. Hence, children will not be able to climb on top of a structure they build. Rather, they will only be able to play inside of a structure they build.

An alternate panel 112 is shown in FIGS. 11-16B. The panel 112 is generally similar to the panel 12. However, the panel 112 does not require a connector, such as the connector 14 to assemble a structure made from a plurality of the panels 112. Further, as will be explained below, due to the configuration of the panels 112, in a structure made from the panels 112, all the panels will be oriented in the same direction.

Figure 12:
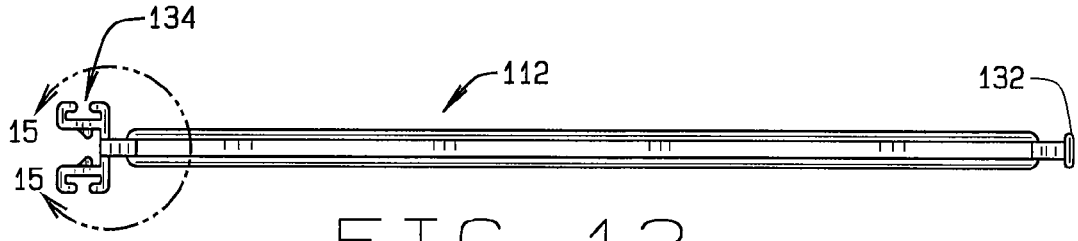
FIG. 12 is a top plan view of the panel.
Figure 11:
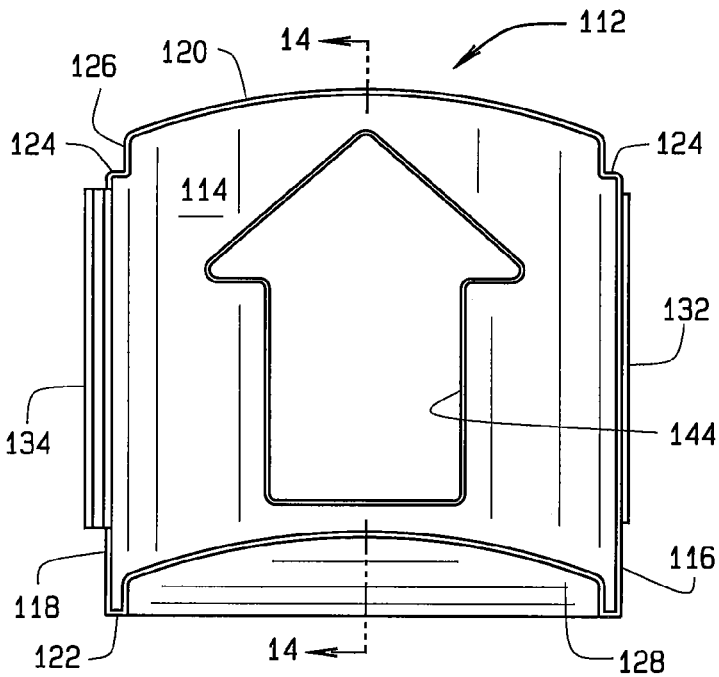
FIG. 11 is a front elevational view of an alternative embodiment of the panel that eliminates the need for a separate connector.
Figure 13:
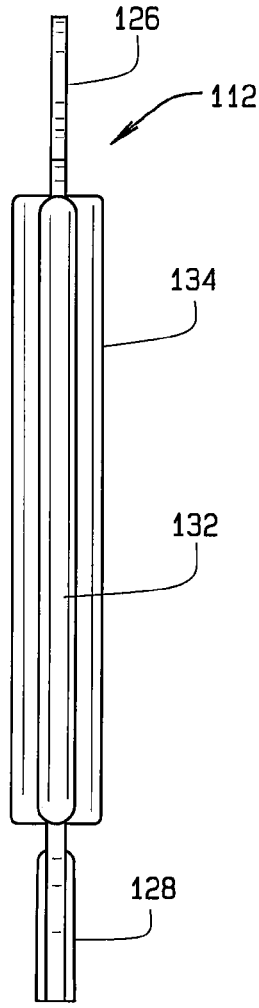
FIG. 13 is a side elevational view of the panel.

Turning initially to FIGS. 11-13, the panel 112 is a one-piece panel which comprises a body or main portion 114 defined by a first side edge 116, a second and opposite side 118, a top 120 and a bottom 122. The top of the side edges 116 and 118 is below the top edge 120, and a step or shoulder 124 is formed at the top of the side edges, such that the panel 112 includes an upper portion or tongue 126 that is narrower in side-to-side width that the remainder or lower portion of the panel 112. Additionally, the tongue 126 narrows or tapers in front-to-back width towards the top of the tongue, such that the tongue is narrower or thinner at its top than at its base. The top edge 120, as best seen in FIG. 11 is convex.

Figure 14:
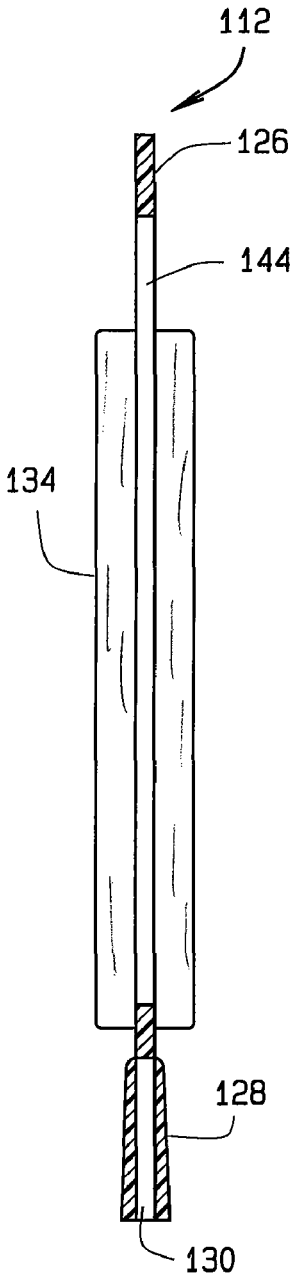
FIG. 14 is a vertical cross-sectional view of the panel taken through the line 14-14 of FIG. 11.
Figure 16A:
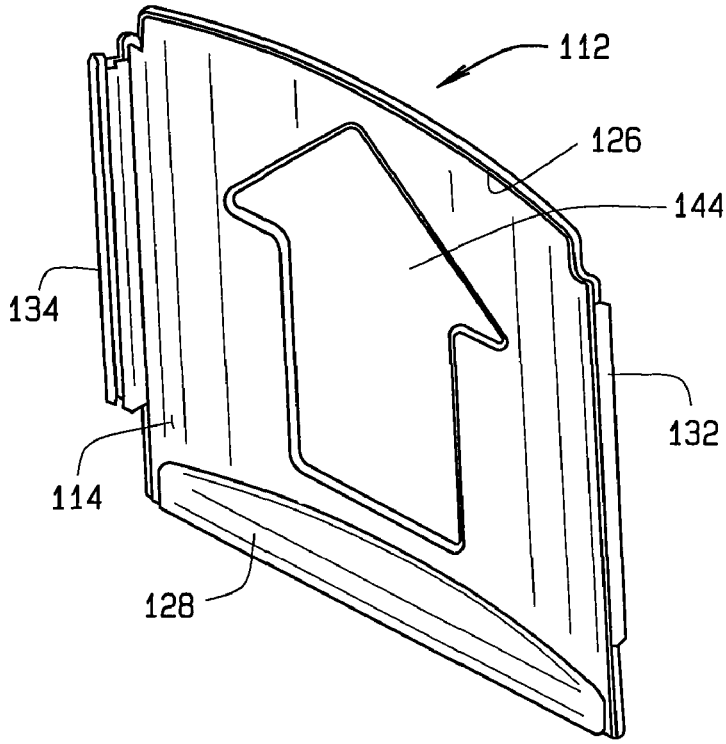
FIGS. 16A and B are perspective views of the panel.
Figure 16B:
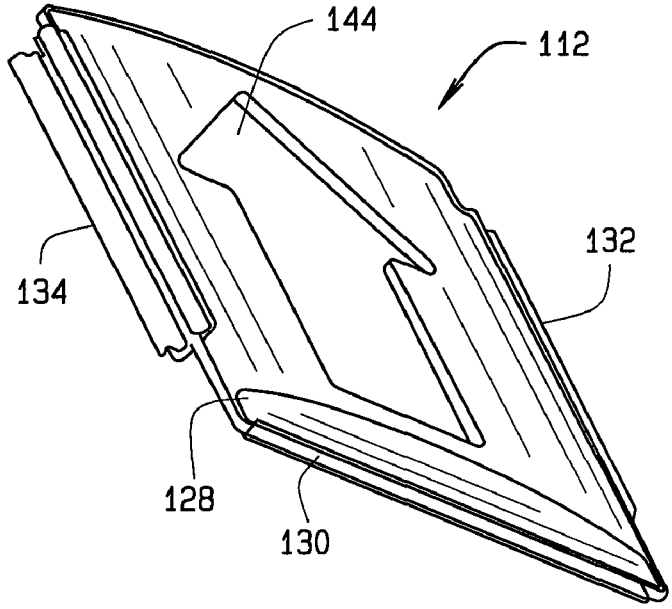

At its bottom, the panel 112 includes an area 128 of wider front-to-back width. As best seen in FIGS. 14 and 16*b*, the area 128 is hollow and defines a downwardly opening slot 130. The slot 130 is shaped complimentarily to the panel upper portion or tongue 126, and is thus defined by generally straight side, front, and back surfaces and a convex upper surface. As will be apparent, the slot 130 is sized to receive the tongue 126. Thus, the slot of one panel can be received over the top of the top portion of another panel, allowing panels to be formed in a column of panels. Like the tongue 126, the slot 130 tapers or narrows in front-to-back width from the bottom of the panel to the top of the slot. The taper of the tongue 126 and the slot 130, along with the curvature of the top edge of the taper, and the corresponding curvature of the slot allow for a fitted or seated connection between the tongue 126 of one panel and the slot 130 of another panel, such that there is a slight friction fit of a slight locking together of the panels, to reduce side-to-side and front-to-back wobble between two connected panels. This produces a better, more stable connection between two vertically connected panels 112.

Figure 15:
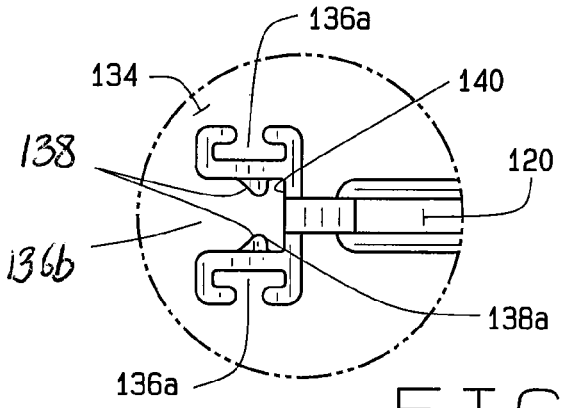
FIG. 15 is an enlarged plan view of the end of the panel, taken through the circle 15-15 of FIG. 12.

In addition, the panel 112 includes a connecting flange 132 extending along the panel side 116 and a channel member 134 on the opposite panel side 118. The channel member 134 and the connecting flange 132 are of substantially equal length, and are positioned at substantially similar positions on their respective sides of the panel. The connecting flange 132 is substantially the same as the connecting flange 42 of the panel 12; and the channel member 134 is substantially the same as the channel member 44 of the panel 12. As with the channel member 44, the channel member comprises two oppositely facing channels 136*a* which are generally parallel to the major face of the panel 112. The two channels 136*a* are each sized to receive the connecting flange 132 of another panel 112, such that when the connecting flange of one panel is received in one of the channels 136*a* of a second panel, the two panels will form a right angle. In addition, the channel member includes a channel 136*b* which opens away from the side 118 of the panel.

Where the channels 136*a* have narrow openings which receive the face of the panel (such that the channels 136*a* are defined by a generally C-shaped edge), the channel 136*b* is generally U-shaped. To accommodate the connecting flange of an adjacent panel, the channel member includes a pair of opposed and aligned ribs 138 which are spaced outwardly from an inner surface 140 of the channel 136*b*. The ribs 138 may be continuous ribs and extend substantially the full length of the channel 136*b*. Alternatively, the ribs 138 my be defined by two or more discrete rib elements. As seen in FIG. 15, the ribs 138 are generally triangular in shape, with a base 138*a* that faces and is generally parallel to, the channel inner surface 140. The ribs are spaced a distance from the channel inner surface a distance sufficient to accommodate the depth of the flange 132; and the ears are spaced apart from each other to define an opening sized to receive a panel 112. Thus, the flange 132 of one panel can be received in the channel 136*b* of an adjacent channel to connect two panels together in a co-planar relationship, to extend the length of a wall. The shape of the flange 132 causes the flange to frictionally engage the channel 136*b* at least along a part of the flange 132 to form a tighter fit between adjacent panels.

Finally, the panel 112 includes a window 144, which is shown to be in the shape of an upwardly facing arrow (i.e., the arrow points toward the convex top surface 120).

Like the panel 12, panels 112 can be connected together to be co-planar or to form right angles, to form a layer of panels of a desired configuration. In addition, a second layer of panels can be formed on top of a first layer, by sliding the slot 130 of the panels of the upper layer of the top portion or tongue 126 of the panels of the lower layer. As a structure of the panels 112 is built up (i.e., as additional layers are added), the panels form columns. This is a bit different from the panels 12, wherein the panels of one layer can traverse two panels of a lower layer. However, the panels 112 can be connected without the use of connectors 14, thereby reducing the number of parts that are required to assemble a structure from the panels 112. As with the panels 12, the panels 112 can not be assembled to form a structure that has "floors" or "ceilings". The panels 112 can only be assembled to form a structure comprised of walls, and the walls can be as tall as the builder wants. Again, as with the panels 12, the window allows a caregiver to be able to see inside of a structure, so that the activity of children within a structure can be observed.

Unlike the panels 12, the panels 112 have a definite top and bottom. Generally, the slot 130 will be at the bottom and the tongue 126 will be at the top, and all panels of a structure will be oriented in the same direction (i.e., with the arrow-shaped opening 144 pointing upwardly). In fact, the construction of the panel 112 requires that all panels in a structure be oriented in the same direction. Although the panels could potentially be used where the "top" 120 is a ground-engaging surface, because the top surface 120 is convex, children are expected to use the panels in an orientation in which the arrow-shaped window 144 points upwardly. As can be appreciated, the curved top 120 makes a single panel less stable when positioned on a floor, thereby making is slightly more difficult to use if used with the top surface as the ground engaging surface.

As various changes could be made in the above constructions without departing from the scope of the invention, it is intended that all matter contained in the above description or shown in the accompanying drawings shall be interpreted as illustrative and not in a limiting sense. For example, the panels 12 could be provided with a central portion which is thicker than the outer portion. The flange 30 could then be defined by the shoulder or step formed between the panel central and outer portions. Although the connecting flange 42, 132 is an elongate member, the connecting flange can be shorter, or can comprise discrete flange-type elements or projections. These examples is merely illustrative.

The invention claimed is:

1. A children's building system comprising a building one-piece panel; said one-piece panel comprising:

a panel body comprising a front face, a back face, a top edge, a bottom edge, a first side edge and a second side edge;

a connecting flange extending along said first side edge, said connecting flange extending generally normally to said front and back faces;

a channel member extending along said second side edge; said channel member defining at least one slot sized and shaped to slidingly receive the connecting flange of an adjacent panel to horizontally connect two panels, such that the panels are generally vertically oriented in a resulting structure; and means for vertically connecting two panels; said connecting means preventing the construction of a horizontal "floor" or "ceiling" in a structure being built from said panels; said means comprising an area at one of said top and bottom edges of said panel body and an elongate tongue defined at the other of said top and bottom edges of said panel body, said tongue having a side-to-side length, a front-to-back width and a depth; said area having a front-to-back width greater than the front-to-back width of said panel body and defining an elongate, generally horizontally extending slot having a front-to-back width sized to slidingly receive said tongue, said slot extending inwardly into said panel from said one of said top and bottom edges, said slot having a side-to-side length and a front-to-back width at least equal to the side-to-side length and front-to-back width of the tongue such that said slot of one panel can slidingly receive the tongue of a second panel; said slot being defined by a slot front wall, a slot back wall, slot side walls, and a slot end wall, such that said slot is open only along said one of said top and bottom edges.

2. The building system of claim 1 wherein said channel member and connecting flange are integrally formed with said panel.

3. The building system of claim 1 wherein said slot is generally T-shaped.

4. The building system of claim 1 wherein said slot of said channel member has a width at a top and bottom of said channel member slot greater than the width of said connector flange, and a width at a central portion of sized to generate a friction fit between said connecting flange and said channel member.

5. The building system of claim 1 wherein said channel member comprises at least three slots; two of said slots being generally parallel to the faces of said panel and one of said slots being generally normal to the faces of said panel.

6. The children's building system of claim 1 wherein said tongue is defined by a portion of said panel which has a side-to-side width that is narrower than the rest of said panel.

7. The children's building system of claim 1 wherein said slot is formed in said panel bottom edge and said tongue is formed at a top of said panel.

8. The children's building system of claim 1 wherein said tongue and slot are shaped complementarily to each other.

9. The children's building system of claim 1 wherein said panel top edge is convex.

10. A children's building system comprising:

a one-piece panel comprising a front face, a back face, a top edge, a bottom edge, a first side edge and a second side edge; said panel defining a generally horizontal slot extending inwardly from said bottom edge, said slot being defined by a slot front wall, a slot back wall, slot side walls, and a slot end wall, such that said slot has a side-to-side length and a front-to-back width and is open only along said bottom edge, and a tongue opposite said slot, said tongue defining at least a part of the top edge of said panel; said tongue being shaped complimentarily to said slot and having a side-to-side length and a front-to-back width no greater than the side-to-side length and front-to-back width of the slot such that a tongue of a first panel can be slidingly received in the slot of a second panel; a shoulder extending inwardly from each side edge, such that when the tongue of a first panel is received in the slot of a second panel, the bottom edge of the second panel will rest on the shoulders of the first panel;

a connecting flange extending along said first side edge, said connecting flange extending generally normally to said front and back faces;

a channel member extending along said second side edge; said channel member defining at least one slot sized and shaped to slidingly receive the connecting flange of an adjacent panel to horizontally connect two panels, such that the panels are generally vertically oriented in a resulting structure.

11. The children's building system of claim 10 wherein said tongue is defined by a portion of said panel which has a side-to-side width that is narrower than the rest of said panel.

12. The children's building system of claim 10 wherein said panel top edge is convex.

13. The children's building system of claim 10 wherein said tongue and said horizontal slot both taper in front-to-back width, such that the tongue and slot are narrower at upper ends of thereof than at their respective bases.

* * * * *